US008186188B1

(12) United States Patent
Brown

(10) Patent No.: US 8,186,188 B1
(45) Date of Patent: May 29, 2012

(54) PORTABLE WEAPON SAFE WITH MOUNTING MODULE AND ACCESS CONTROLLER PROVIDING RAPID ACCESS TO A WEAPON

(76) Inventor: Dennis Brown, Grapevine, TX (US)

( * ) Notice: Subject to any disclaimer, the term of this patent is extended or adjusted under 35 U.S.C. 154(b) by 0 days.

(21) Appl. No.: 13/006,756

(22) Filed: Jan. 14, 2011

(51) Int. Cl.
*B65D 55/14* (2006.01)
*E05B 65/48* (2006.01)
*E05B 65/52* (2006.01)

(52) U.S. Cl. ..... 70/63; 70/85; 70/86; 70/87; 70/88; 109/45; 109/47; 211/4; 211/64; 42/70.11

(58) Field of Classification Search ..... 70/63, 85–88; 109/45, 47; 206/514; 220/23.89, 23.87, 220/810; 42/70.08, 70.01, 70.11; 224/911, 224/912, 913; 312/311, 215, 222, 319.2, 312/327, 328; 211/4, 64; 248/551
See application file for complete search history.

(56) References Cited

U.S. PATENT DOCUMENTS

| | | | | |
|---|---|---|---|---|
| 4,524,904 | A * | 6/1985 | Masse et al. | 232/7 |
| 4,768,021 | A | 8/1988 | Ferraro | |
| 4,800,822 | A * | 1/1989 | Adkins | 109/19 |
| 4,890,466 | A * | 1/1990 | Cislo | 70/63 |
| 4,987,836 | A * | 1/1991 | Owen | 109/52 |
| 5,056,342 | A | 10/1991 | Prinz | |
| 5,111,755 | A * | 5/1992 | Rouse | 109/25 |
| 5,118,175 | A | 6/1992 | Costello | |
| 5,168,994 | A * | 12/1992 | Beletsky et al. | 206/317 |
| 5,172,575 | A | 12/1992 | Fisher | |
| 5,416,826 | A * | 5/1995 | Butler | 379/40 |
| 5,579,909 | A | 12/1996 | Deal | |
| 5,598,151 | A | 1/1997 | Torii | |
| 5,701,770 | A | 12/1997 | Cook et al. | |
| 5,901,589 | A * | 5/1999 | Cordero | 70/63 |
| 6,082,601 | A | 7/2000 | Standish | |
| 6,260,300 | B1 * | 7/2001 | Klebes et al. | 42/70.11 |
| 6,363,760 | B1 | 4/2002 | Sigmond | |
| 6,405,861 | B1 | 6/2002 | Siler et al. | |
| 6,488,148 | B1 * | 12/2002 | Woodson | 206/317 |
| 6,843,081 | B1 * | 1/2005 | Painter | 70/63 |
| 7,116,224 | B2 * | 10/2006 | Mickler | 340/568.1 |
| 7,178,370 | B2 * | 2/2007 | Engel | 70/63 |
| 7,434,427 | B1 * | 10/2008 | Miresmaili | 70/63 |
| 7,478,724 | B2 * | 1/2009 | Vor Keller | 206/317 |
| 8,020,416 | B2 * | 9/2011 | Talmage et al. | 70/85 |

(Continued)

FOREIGN PATENT DOCUMENTS

| | | |
|---|---|---|
| CN | 1344856 | 4/2002 |
| CN | 2518786 Y | 10/2002 |
| CN | 2698160 Y | 5/2005 |
| CN | 101034483 | 9/2007 |

(Continued)

*Primary Examiner* — Lloyd Gall
*Assistant Examiner* — David E Sosnowski
(74) *Attorney, Agent, or Firm* — Michael Diaz

(57) ABSTRACT

A system for securely storing a weapon. The system includes a tray for containing a weapon. The tray has an opening for accessing a weapon. The system also includes a portable safe having an interior space sized and shaped for retaining the tray and the contained weapon. In addition, the system includes a mounting module attachable to a fixed surface. The mounting module includes an interior space for holding the portable safe and an access control system for locking the portable safe within the interior space of the mounting module. The access control system allows access by an authorized user and denies access of the weapon within the portable safe to an unauthorized user. The weapon is contained in the tray, the tray is retained in the portable safe and the portable safe is held in the interior space of the mounting module.

16 Claims, 11 Drawing Sheets

U.S. PATENT DOCUMENTS

| | | | | |
|---|---|---|---|---|
| 2007/0006328 | A1* | 1/2007 | Sogo | 726/34 |
| 2011/0001407 | A1* | 1/2011 | Stradiota | 312/237 |
| 2011/0146359 | A1* | 6/2011 | Elsner et al. | 70/63 |
| 2011/0175730 | A1* | 7/2011 | Stevenson | 340/540 |
| 2011/0247950 | A1* | 10/2011 | McGee | 206/317 |

FOREIGN PATENT DOCUMENTS

| | | | |
|---|---|---|---|
| CN | 201043407 | Y | 4/2008 |
| CN | 2823492 | Y | 10/2010 |
| FR | 2932967 | | 1/2010 |
| WO | W02009070499 | | 6/2009 |

* cited by examiner

PORTABLE WEAPON SAFE WITH MOUNTING MODULE AND ACCESS CONTROLLER PROVIDING RAPID ACCESS TO A WEAPON

BACKGROUND OF THE INVENTION

1. Field of the Invention

This invention relates to firearms. Specifically, and not by way of limitation, the present invention relates to a portable weapon safe providing rapid access to a weapon.

2. Description of the Related Art

Currently, in the United States, more people are purchasing firearms than ever before. Although people purchase firearms for a wide variety of reasons, personal protection is the primary purpose for the increased demand in owning a firearm. The popularity in the utilization of firearms as a means of self-defense has created unique challenges for the secure storage and rapid retrieval of firearms. Gun safes have always been the most effective and popular way to secure a firearm from unauthorized use and theft. Although there are a variety of different safes on the market, all of these safes have inherent limitations that result in gun owners having to make unnecessary and potentially dangerous compromises to achieve their objectives.

Large stationary safes are effective at storing firearms safely and deterring theft, but suffer from some serious disadvantages, such as mobility of the safe and rapid accessibility of the stored firearm. Gun owners often overcome these limitations by removing the firearm from the safe and placing the firearm in close proximity to themselves. This dangerous and sometimes tragic scenario is most often observed when a firearm owner, before going to bed, removes the firearm from the safe and places it in a drawer or on top of a nightstand for quick retrieval. However, security of the firearm is compromised, exposing the firearm to children and other unauthorized persons.

In addition, there are existing smaller safes specifically designed for handguns which utilize rapid access technology, such as biometrics. These safes offer improved accessibility over the larger stationary safes, but are limited in deterring theft, portability, safety and rapid firearm retrieval. Due to the small size, these safes are ineffective in deterring theft. A robber can simply remove the entire safe and contents. Although most of these safes have provisions that allow them to be bolted down to an immovable object, once affixed to the unmovable object, the safe is then immobile, thereby losing the important advantage of portability. In order for gun owners to achieve some kind of portability and have their firearms by their sides, the gun owners are forced to purchase multiple safes. However, the use of multiple safes is both costly and requires that the firearm be physically handled when moving the firearm from one safe to another safe. This action increases the possibility of an accidental discharge caused by the increased handling of the firearm. Another concern for safety is the method used to position the firearm in the safe. Most of these safes are designed for the firearm to be positioned in the confines of the safe laying on the bottom surface of the safe. Besides not offering any physical protection for the firearm when transported to different locations, this method of storage leaves an owner vulnerable to an accidental discharge by not protecting the trigger during the removal of the firearm from the safe. By not protecting the trigger, an owner is free to grab the totally exposed firearm and position the shooting finger in the trigger guard while extracting the firearm from the safe. This action enables the owner to potentially discharge the firearm while gaining access. This possibility is increased as the urgency and excitement to withdraw the firearm is increased. In addition, any rapid firearm retrieval is lost due to the positioning of the firearm in the safe. After the safe is opened, the owner is required to physically reach his hand into the safe and retrieve the firearm that is positioned on a flat surface. Because the handle of the firearm is not totally exposed and easily grasped, valuable time is wasted in trying to retrieve the firearm.

Additionally, many government agencies and security firms utilize firearms for the protection of valuables, the security of controlled areas and, personal protection. Although the majority of situations are most effective if the firearm is carried on an individual's person, such as carrying the firearm in a holster, there are many situations where this method of carriage can be extremely dangerous. Situations, such as those found with the Immigration and Customs Inspection facilities, the defense of a cockpit on commercial airliners, or a correctional facility are just a few examples of where maintaining a firearm in a controlled but readily accessible environment could increase effectiveness, efficiency, and safety compared with the carriage method. Carrying a firearm while dealing with large groups of people increases the risk of having the firearm stolen from an agent and used on that agent or other innocent victims. Also, the issuance of a firearm to each individual has the potential for creating both dangerous and costly results. With more personnel possessing firearms, there is a higher probability that an unintentional discharge will occur or that the firearms will be lost or stolen. This is particularly relevant if the individual is allowed to take the firearm home, now exposing the individual's family and friends to these risks. The other notable disadvantage is the increased cost associated with arming each individual with a firearm, even though that firearm is only utilized in a confined space for a small proportion of an individual's work day.

Additionally, some safes offer the ability to retract the firearm from the safe by using mechanical linkage and physical force as the energy source. After access is achieved, either by an electric or mechanical locking device, the operator must physically open the safe door while withdrawing the firearm from the interior of the safe. This two step process requires additional time to be expended in gaining access to the firearm. In addition, the internal mechanical linkage requires the safe to be large and heavy, which severely limits portability. As discussed above, due to the safes smaller size, these safes are ineffective in deterring theft. A robber can simply remove the entire safe and contents. Although most of these safes have provisions that allow them to be bolted down to an immovable object, once affixed to the unmovable object, the safe is then immobile, thereby losing the important advantage of portability. In order for gun owners to achieve some kind of portability and have their firearms by their sides, the gun owners are forced to purchase multiple safes. However, the use of multiple safes is both costly and requires that the firearm be physically handled when moving the firearm from one safe to another safe. This action increases the possibility of an accidental discharge caused by the increased handling of the firearm.

In addition, some safes are portable and have the ability for rapid firearm retrieval by using a spring-activated ejectable drawer or other means which extends the firearm out of the interior of the safe. These safes maintain a constant pressure on the door, making opening and closing of the locking device cumbersome and difficult. Although portable, the safe and firearm are completely exposed to theft. Although the safe may have provisions that allow them to be bolted down to an unmovable object, once affixed to the unmovable object, the safe is then immobile, thereby losing the important advantage of portability. In order for gun owners to achieve some kind of portability and have their firearms by their sides, the gun owners are forced to purchase multiple safes. However, the use of multiple safes is both costly and requires that the firearm be physically handled when moving the firearm from one safe to another safe. This action increases the possibility of an accidental discharge caused by the increased handling of the firearm. Another concern for safety is the method used to position the firearm in the safe. These safes are designed for the firearm to be positioned in the confines of the safe laying on the bottom surface of the safe. Besides not offering any physical protection for the firearm when transported to different locations, this method of storage leaves an owner vulnerable to an accidental discharge by not protecting the trigger during the removal of the firearm from the safe. By not protecting the trigger, an owner is free to grab the totally exposed firearm and position the shooting finger in the trigger guard while extracting the firearm from the safe. This action enables the owner to potentially discharge the firearm while grasping the firearm. This possibility is increased as the urgency and excitement to withdraw the firearm is increased. In addition, any rapid firearm retrieval is lost due to the positioning of the firearm in the safe. After the safe is opened, the owner is required to physically reach his hand into the safe and retrieve the firearm that is positioned on a flat surface. Because the handle of the firearm is not totally exposed and easily grasped, valuable time is wasted in trying to retrieve the firearm.

Additionally, some safes offer a variety of secure methods to gain access to the firearm but fail to address the important aspect of rapid firearm retrieval from the safe. This type of safe is configured as a rectangle box that requires that the firearm be extracted from the container by reaching into the container and picking up a firearm that is laid on the bottom surface of the safe. This action is cumbersome and time consuming. This action is also unsafe as the trigger of the firearm is exposed during the extraction process, enabling the operator to potentially discharge the firearm while gaining access. This possibility is increased as the urgency and excitement to withdraw the firearm is increased. Additionally, due to the safe's smaller size, these safes are ineffective in deterring theft. A robber can simply remove the entire safe and contents.

In addition, some portable safes offer the ability to mount the safe to a bracket, which is affixed to a stationary fixture. In order to attach and detach the safe to the bracket, the safe must be opened and a mechanical part placed within or removed from the interior of the safe. This action is time consuming and unnecessarily exposes the firearm.

Another alternative for deterring the theft of the safes and stored firearms is to use a metal cable attached to the safe on one end and a structure, such as a bed frame or desk, on an opposite end. This form of security is easily compromised by simply cutting the cable or dismantling the structure that the cable is attached to. There is also the inconvenience of attaching and reattaching the long and cumbersome cable every time the user desires to secure the safe.

In addition, there are some safes that have integrated a mechanical or biometric access component within the safe and are advertised as portable. However, these safes tend to be bulky and heavy, having very limited portability and providing no protection from theft. Additionally, some safes are designed for multiple uses, such as the security of firearms and storage of other valuables. These safes might maintain security and possess access technology, but lack portability and the ability to retrieve the firearm in a rapid and safe manner.

Additionally, gun owners and agencies often use trigger guards or some other locking device, which disables the firearm from firing. These locking devices leave the firearm exposed to the elements. It is also time consuming to remove the locking device from the firearm and provides no protection from theft.

Furthermore, in many areas, state laws prohibit the carriage or transportation of open firearms in the confines of the vehicle. The trunk is generally acceptable, unless the firearm is contained within a safe or containment vessel that limits access. Oftentimes, firearms are carried in containers that are not designed for such purposes. This often results in transporting a firearm that is unsecured and vulnerable to unauthorized access or theft. Additionally, the firearm is physically unprotected from the surrounding environment, leaving it vulnerable to damage from dropping, denting or scratching of the firearm. Furthermore, if a firearm is transported in a commercial aircraft, it must meet the requirements dictated by the Transportation Security Administration (TSA).

An apparatus is needed that will provide a secure environment for the storage of a weapon limiting controlled access to only authorized persons. Furthermore the apparatus should have the option of being stationary or portable, allowing the operator too quickly and easily secure the apparatus to a fixed platform without exposing the weapon to an unsecured condition. Additionally, a rapid access and retrieval portable safe is needed that allows for the transport of a secure weapon throughout a home or business, in a vehicle or travel on a commercial airliner while meeting the requirements of the TSA. It would also be advantageous to have an apparatus that is capable of integrating a variety of quick access options, either mechanical access, with key locks and push buttons or electrical access utilizing biometrics, remote wired and wireless devices, motion/sound detection, and security alarm systems. The apparatus should provide for the rapid and safe retrieval of a weapon, and do so during times of limited visibility. It is an object of the present invention to provide such an apparatus.

SUMMARY OF THE INVENTION

The present invention includes a portable safe which is capable of safely storing a handgun-size weapon and accessories. The present invention also provides quick access to a weapon stored in the portable safe. In one aspect, the present invention is directed to a system for securely storing a weapon. The system includes a tray for containing a weapon. The tray has an opening for accessing a weapon. The system also includes a portable safe having an interior space sized and shaped for retaining the tray and the contained weapon. In addition, the system includes a mounting module attachable to a fixed surface. The mounting module includes an interior space for holding the portable safe and an access control system for locking the portable safe within the interior space of the mounting module and controlling access to the interior of the portable safe.

The access control system allows access by an authorized user and denies access of the weapon within the portable safe to an unauthorized user. The weapon is contained in the tray, the tray is retained in the portable safe and the portable safe is held in the interior space of the mounting module. The authorized user accesses the access control system to access the weapon in the tray.

In another aspect, the present invention is directed to a portable safe for securely storing a weapon. The portable safe includes a tray for containing a weapon. The tray has an opening for accessing a weapon. The portable safe also includes an enclosure having a door and an interior space sized and shaped for retaining the tray and the contained weapon. The tray extends at least partially outside the enclosure when the door is opened. The weapon is contained in the tray and the tray is retained in the portable safe.

DESCRIPTION OF THE INVENTION

Figure 1:
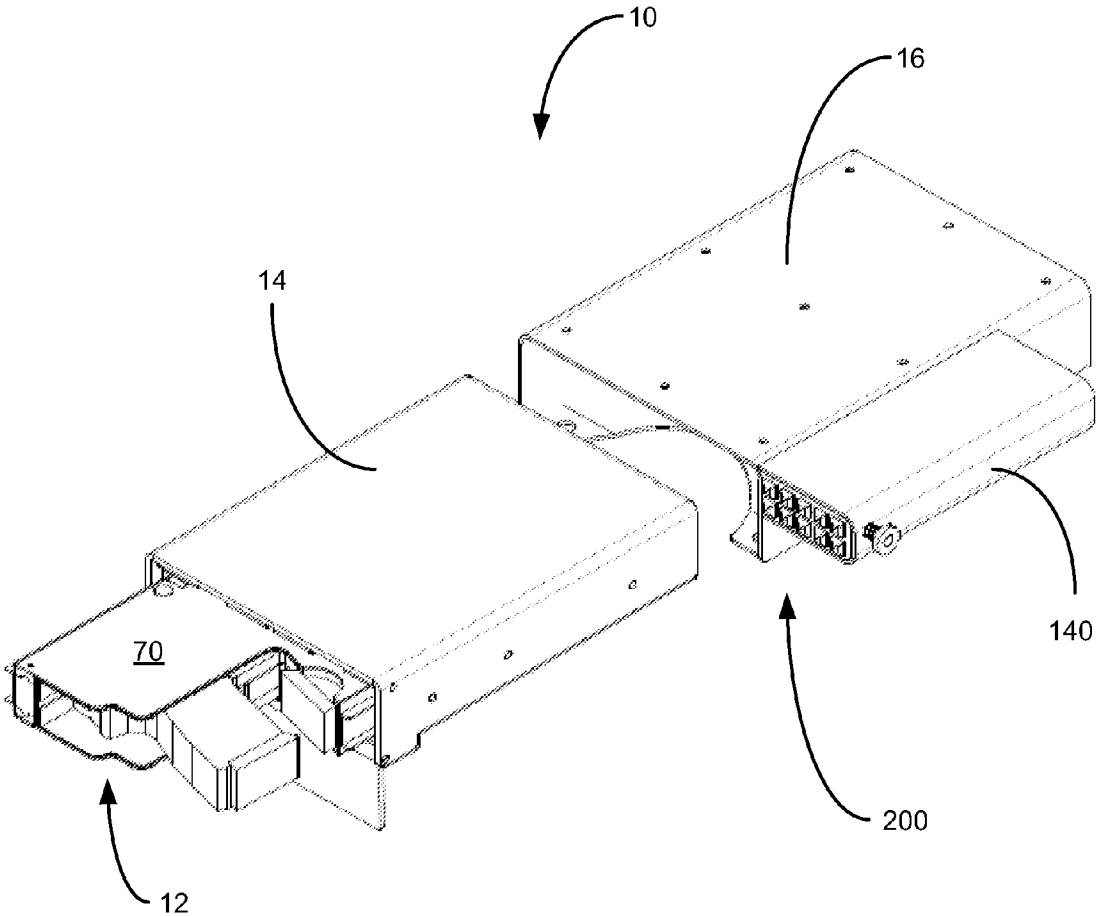
FIG. 1 is a front perspective view of a portable weapon safe system in the preferred embodiment of the present invention.

The present invention is a portable weapon safe providing rapid access to a weapon. FIG. 1 is a front perspective view of a portable weapon safe system 10 in the preferred embodiment of the present invention. The system 10 includes a weapon tray 12 stored within a portable safe 14 and a mounting module 16. The portable safe may be securely stored in the mounting module 16. The mounting module is preferably affixed to a fixed surface (not shown).

Figure 2:
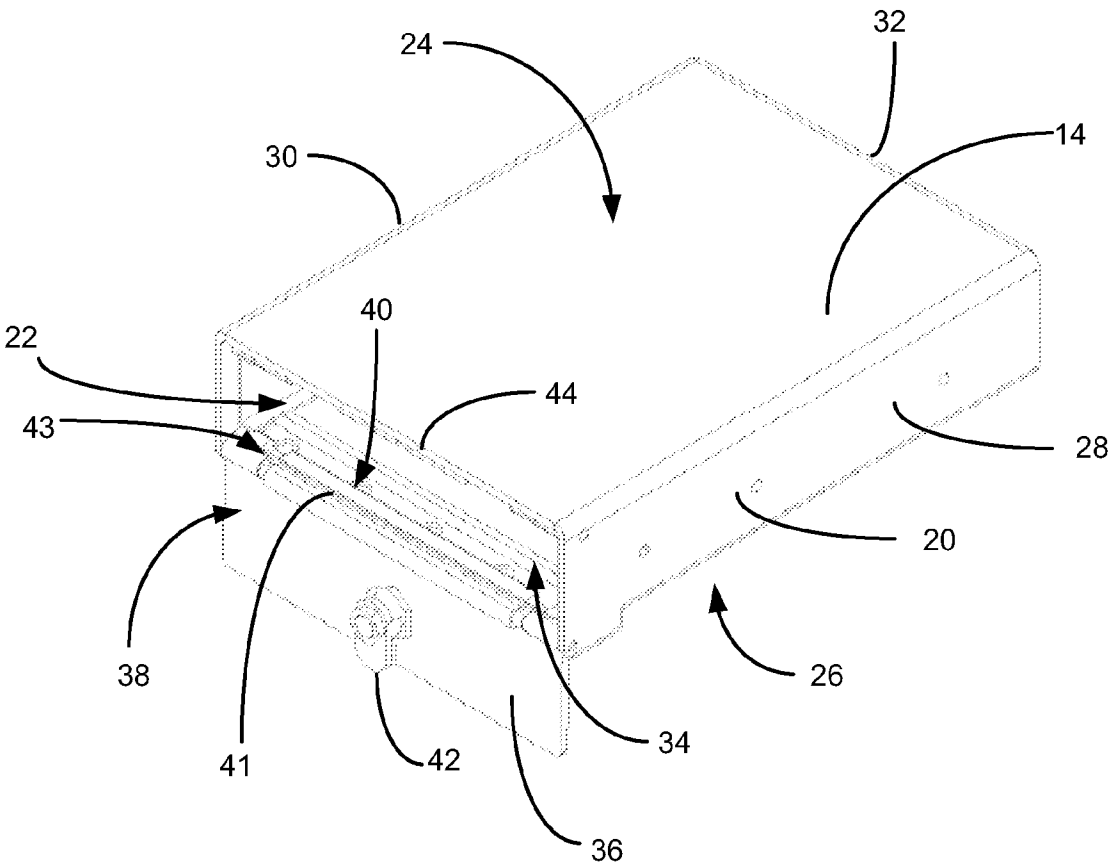
FIG. 2 is a front perspective view of the portable safe removed from the mounting module.

FIG. 2 is a front perspective view of the portable safe 14 removed from the mounting module 16. The portable safe 14 includes a main body 20. The main body is a container or enclosure having an interior space 22. Preferably, the main body is a rectangular box having flat surfaces. However, the portable safe may be any size and shape which is able to accommodate a weapon, such as a handgun or taser in its interior. Preferably the interior space is defined by a top face 24, a bottom face 26, two side faces 28 and 30, and an end face 32. In one embodiment, a carrying handle (not shown) is affixed to an exterior surface of the bottom face 26, thereby enhancing the ease in handling and transporting of the portable safe 14. Furthermore, the portable safe 14 includes an open face 34 having a closeable door 36.

Figure 10:
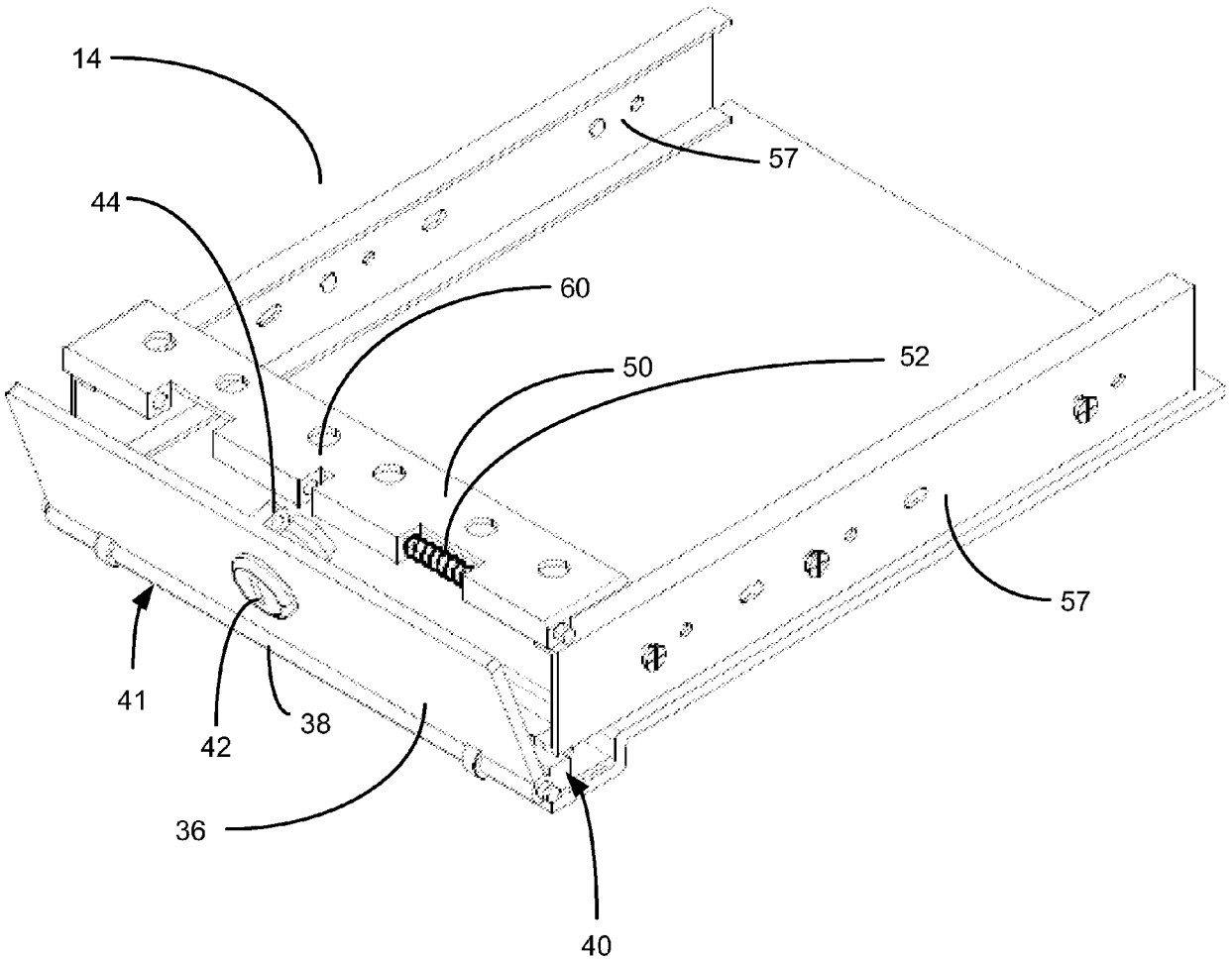
FIG. 10 is a front perspective view of the portable safe of FIG. 2 with the top, back and side faces removed.

FIG. 10 is a front perspective view of the portable safe 14 with the top face 24, side faces 28 and 30 and end face 32 removed. In one embodiment, the door may be supported and rotated using a door hinge assembly 38 having a door hinge mechanism 41 and door hinge support 40. The door hinge mechanism 41 may be affixed to the bottom interior of the door and the hinge support 40 affixed to the front edge of the bottom face 26 of the main body 20. In one embodiment, to manually secure the door in a closed position, a key lock 42 may be affixed to a center portion of the door. A top interior surface of the door may contain an interior door locking device 44. Preferably, the door 36 is spring loaded by a torsion spring to open 180 degrees from the closed or locked position. In addition, a locking rod guide assembly 50 may be affixed to the top face of the main body near the open face. The locking rod guide assembly 50 may be multi-functional, serving as a guide for a locking rod and spring 52, a stop for the door in the closed position, an interior locking surface for the key lock 42 and an access control locking guide 60. In one embodiment, when the door 36 is fully closed, the interior door locking device 44 fits into the access control locking guide 60 of the locking rod guide assembly 50. The locking rod 52, when moved to the closed position, penetrates the door locking device 44 and access control locking guide 60 of the locking rod guide assembly, locking the door 36.

Figure 3:
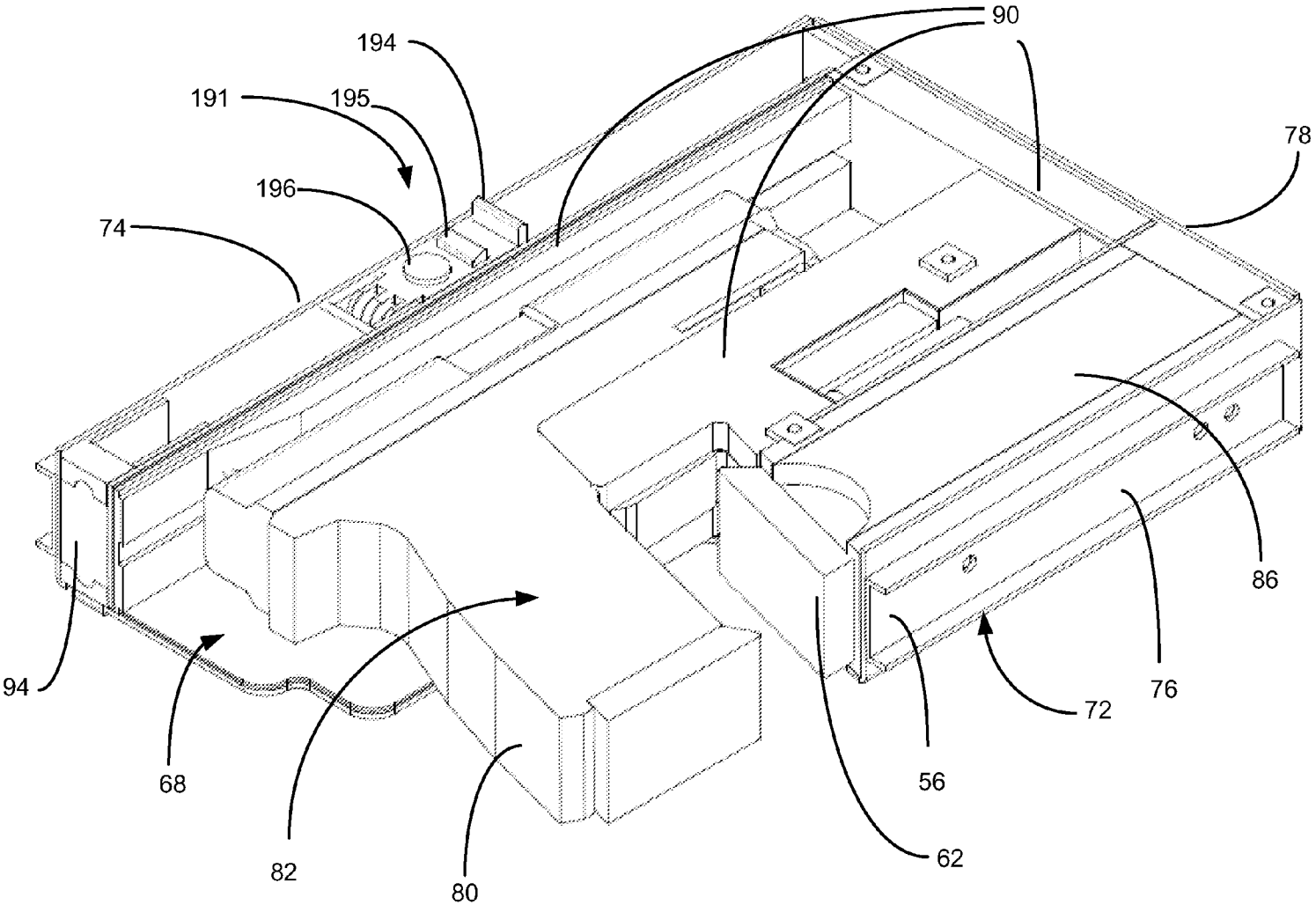
FIG. 3 is a front perspective view of the weapon tray.
Figure 4:
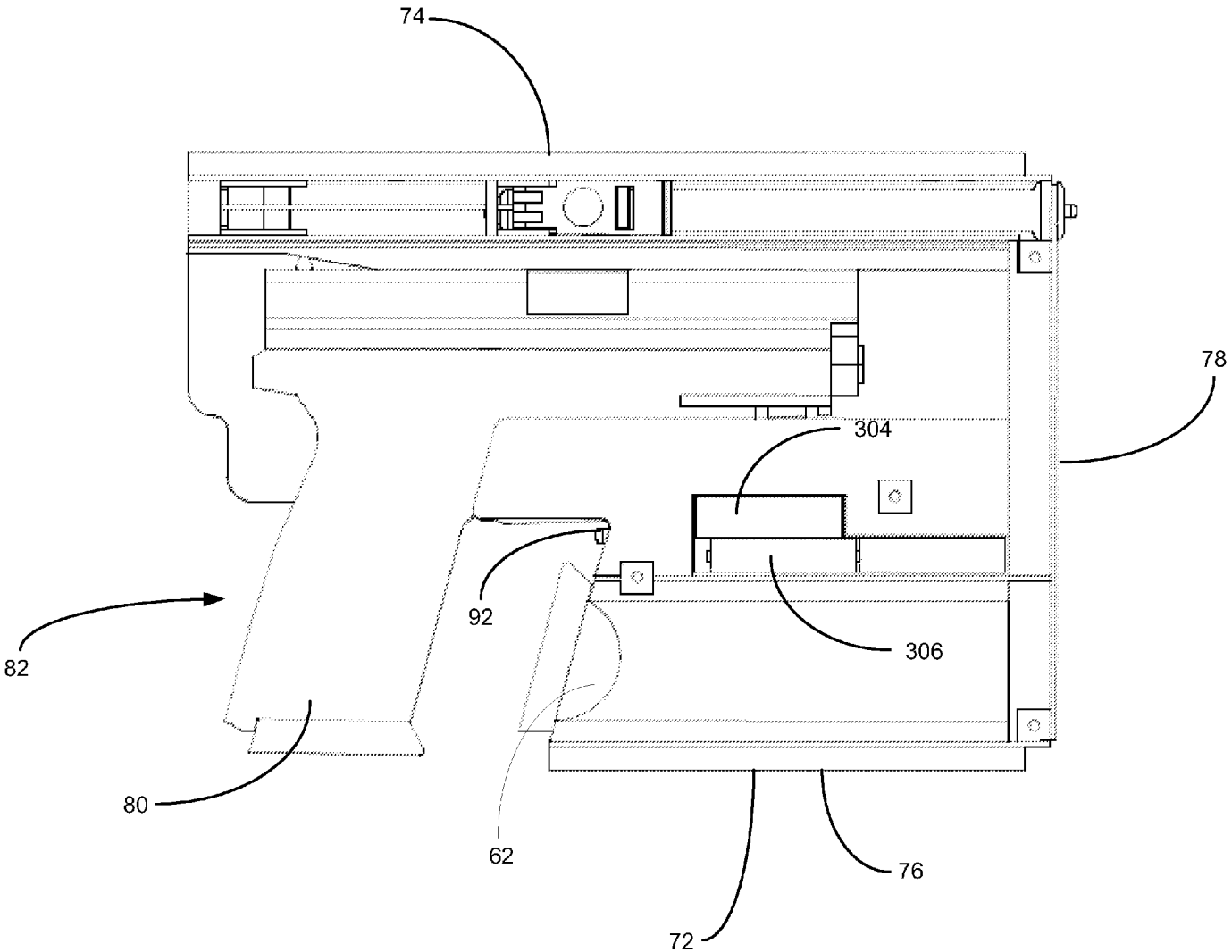
FIG. 4 is a top view of the weapon tray of FIG. 3.

FIG. 3 is a front perspective view of the weapon tray 12 with the top side removed. The weapon tray is sized and shaped to fit within the interior space 22 of the portable safe 14. FIG. 4 is a top view of the weapon tray 12 of FIG. 3. The tray provides containment and storage of a weapon 80, such as any firearm or taser, and optionally, accessories of the weapon, such as an ammunition clip 62. The weapon tray 12 is housed in the interior space 22 of the main body 20 of the portable safe 14 when storing the weapon. The weapon tray 12 is defined by a top face 70, a bottom face 72, two opposing side faces 74 and 76, and an end face 78. The top and bottom faces preferably provide an open configuration to allow the handle of the weapon 80 and accessories (e.g., ammunition clip 62) to be exposed at area 82. In the preferred embodiment of the present invention, the trigger and trigger guard of the weapon 80 are not accessible when positioned in the weapon tray 12, thereby eliminating the risk of an accidental misfire when physically extracting the weapon from the tray. A front face 68 of the weapon tray 12 remains open for extracting the weapon from the tray. The top face 70 may include a removable panel allowing access of internal components. Weapon tray drawer slides 56 may be affixed to the sides of the weapon tray 12 and inserted into portable safe drawer slides 57 (see FIG. 10) affixed to the interior sides of the main body for the portable safe 14. The drawer slides enable the tray to smoothly reciprocate to an extended or retracted position.

Figure 9:
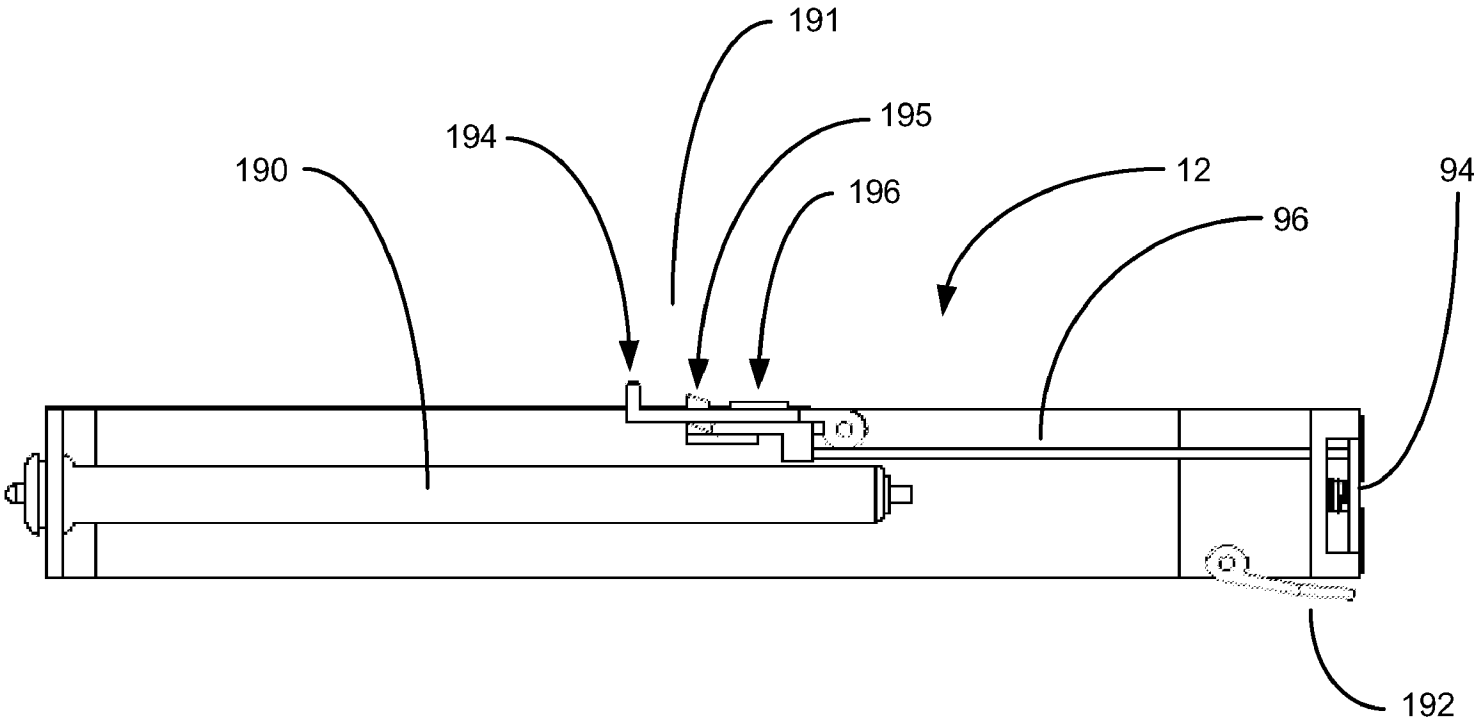
FIG. 9 is an open side view of the tray of FIG. 3.
Figure 11:
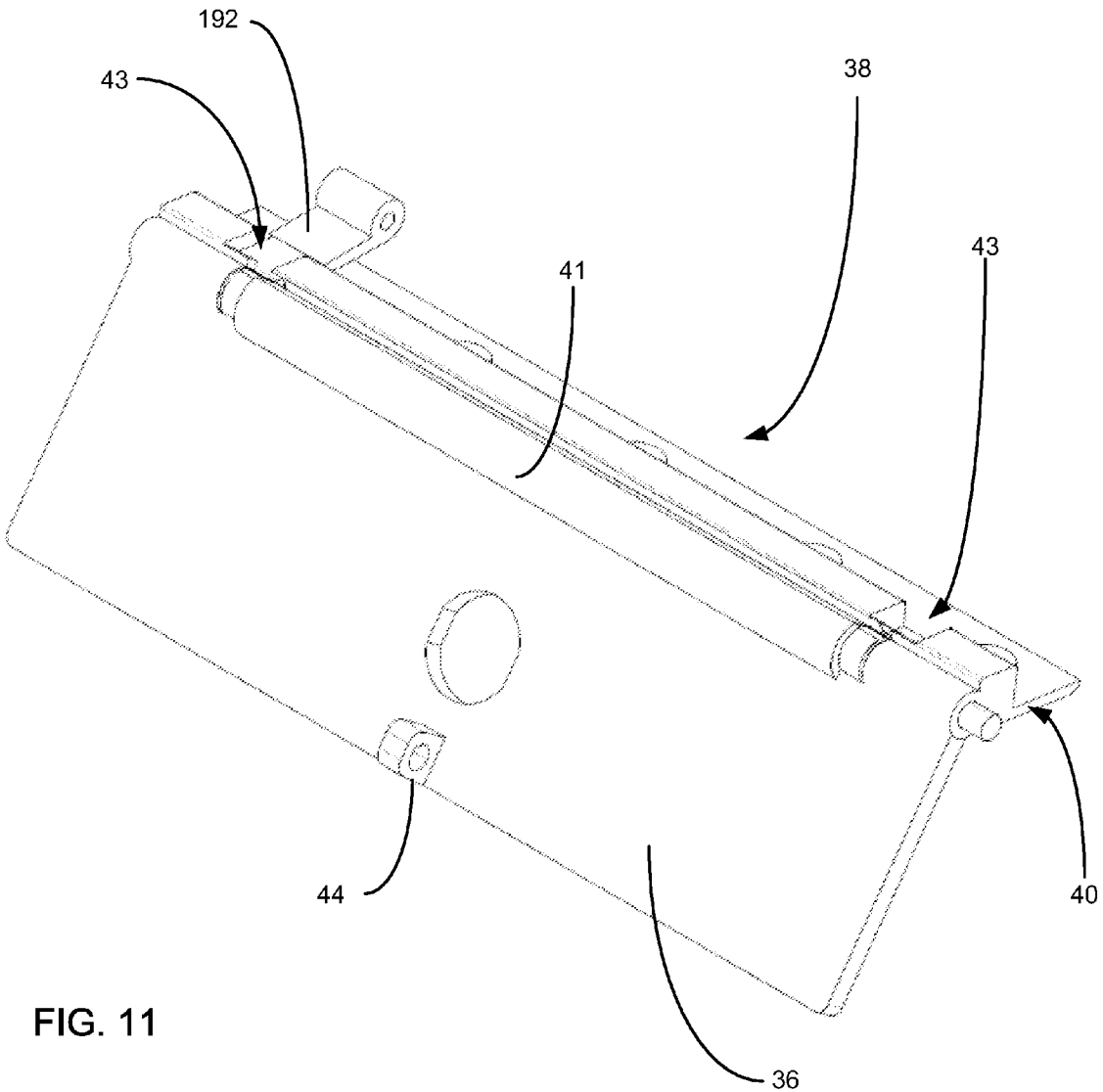
FIG. 11 is a front perspective view of the safe door and hinge assembly.

FIG. 9 is an open side view of the weapon tray 12. A gas spring 190 is mounted within the interior of the weapon tray and used to provide the potential energy to extend the weapon tray from the body of the safe, thereby providing ease in access to the weapon and any weapon accessories. A weapon tray holdback mechanism 192 mounted to the bottom face 72 of the weapon tray 12 is spring loaded by a torsion spring forcing the mechanism to the down position and seated in the door hinge support recess 43 of the portable safe 14. FIG. 11 is a front perspective view of the safe door 36 and hinge assembly 38. The weapon tray holdback mechanism 192 enables the weapon tray 12 to be supported in a retracted or closed position. With the weapon tray 12 in the closed or retracted position, the door 36 of the portable safe 14 may be easily closed and locked with no force from the gas spring acting upon the door, thus allowing the door to be easily closed without the user fighting resistance from the force of the gas spring. To gain access to the weapon 80 or any accessories stored therein, the key lock 42 may be turned to the unlock position and the door 36 automatically opened (i.e., spring-loaded to the open position). As the door swings to the open position, 180 degrees of travel, at approximately 160 degrees of travel from the closed position, the door hinge 41 forces the weapon tray holdback mechanism 192 out of the door hinge support recess 43 of the door hinge support 40. This action allows the tray to partially extend from the interior space 22 of the portable safe to expose the weapon 80 and weapon accessories. A weapon tray stop assembly 191 maintains the weapon tray 12 in a stationary position for insertion and retraction of the weapon, as well as releasing the weapon tray 12 for removal from the portable safe 14. Integrated within the weapon tray stop assembly 191 is a spring loaded weapon tray stop mechanism 194 that is responsible for keeping the weapon tray 12 from over extending from the interior of the weapon safe during retraction. Also Integrated within the weapon tray stop assembly 191 is a spring loaded weapon tray stop retraction mechanism 195 which keeps the weapon tray 12 from retracting back into the portable safe main body interior space 22 while the weapon and accessories are inserted into the weapon tray's 12 compartments. The weapon tray 12 can be mounted universally. In particular, the weapon tray may be positioned within the interior space 22 of the portable safe 14 with either the top face 70 up or down, which enables the weapon 80 to be used by both right and left-handed shooters. The weapon tray 12 can be entirely withdrawn from the portable safe by pushing down on the weapon tray stop release mechanism 196 integrated within the weapon tray stop assembly 191 and releasing the stops on the weapon tray drawer slides 56. The weapon tray 12 can be removed to change protective inserts for different weapons, replace batteries, or to change the positioning of the tray for left or right handed shooters.

In the preferred embodiment of the present invention, the weapon and accessories are positioned in the weapon tray and held in place by an insert or inserts 90 made of soft material that is molded and conforms to the dimensions of each model and brand of weapon. The insert provides limited weapon movement during transport and physical protection from dents or scratches. Additionally, the trigger and trigger guard of the weapon are not accessible when positioned in the weapon tray, thereby eliminating the risk of an accidental misfire when physically extracting the weapon from the weapon tray. Upon extension of the weapon tray 12 from the interior space 22 of the portable safe 14, a LED light 92 positioned at the base of the weapon trigger guard may illuminate the weapon and weapon accessories providing the user adequate visibility to retract the weapon or accessories from the weapon tray 12. The LED light may be time controlled to enable the light to be extinguished after a designated time has elapsed. An LED light controller 304 and battery container 306 is positioned between the weapon and accessory compartments.

The weapon tray 12 is retracted back into the portable safe main body interior space 22 by manually pushing on the spring loaded weapon tray closure mechanism 94 (see FIGS. 3 and 9). As physical force is applied to the weapon tray closure mechanism 94, a weapon tray release rod 96 attached to the weapon tray stop assembly 191 is activated, forcing the weapon tray stop release mechanism 195 to the down position allowing the weapon tray 12 to retract. Additional physical force overcomes the force of the gas spring 190 and moves the weapon tray forward to the retracted or closed position within the interior space 22. As the weapon tray 12 reaches the retracted position the weapon tray hold back mechanism 192 activates to hold the weapon tray in the closed position. The weapon tray 12 may be configured in any shape or size which allows the tray to easily slide in and out of the interior space 22 of the portable safe 14.

Figure 5:
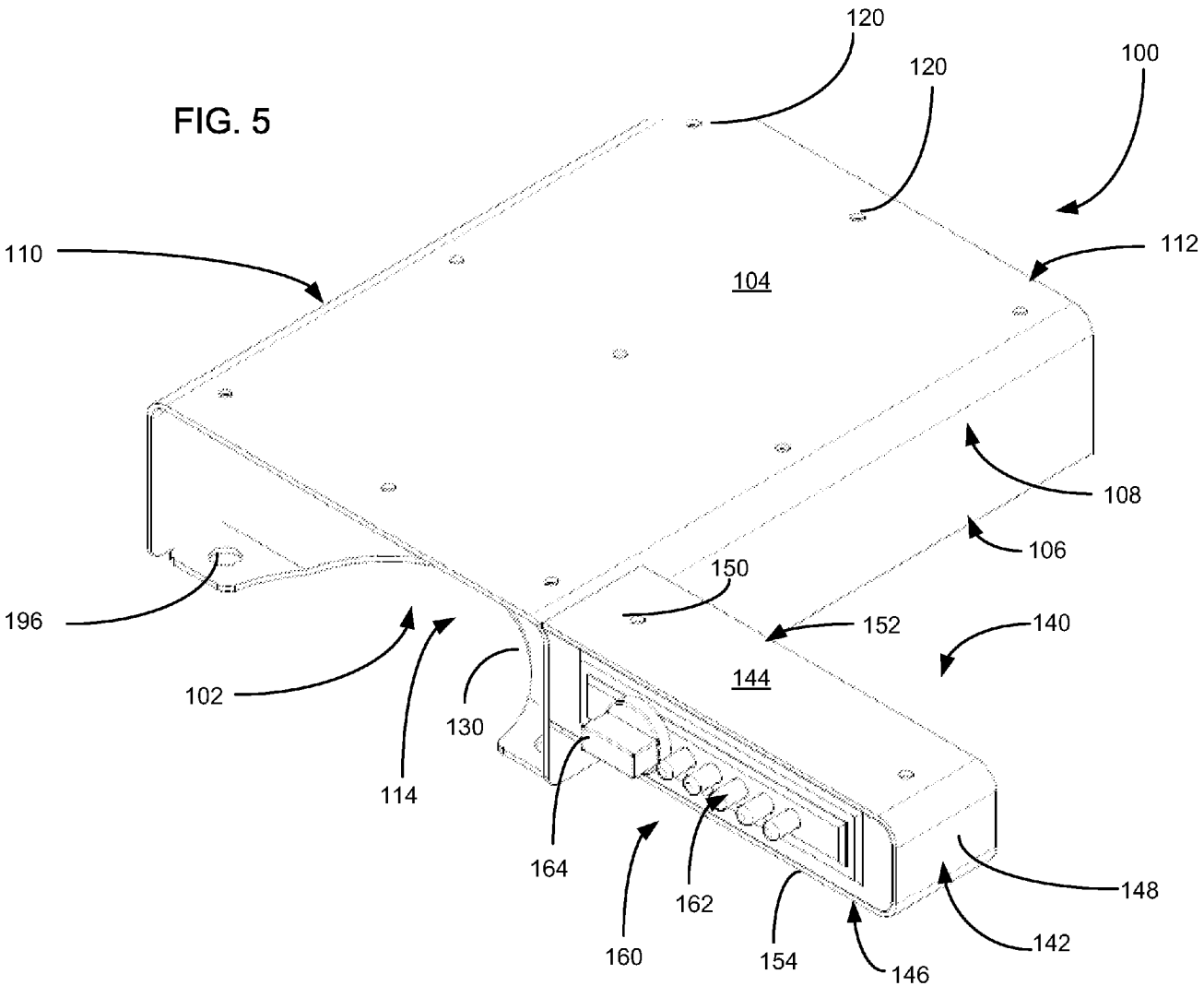
FIG. 5 is a front perspective view of the mounting module in one embodiment of the present invention.
Figure 6:
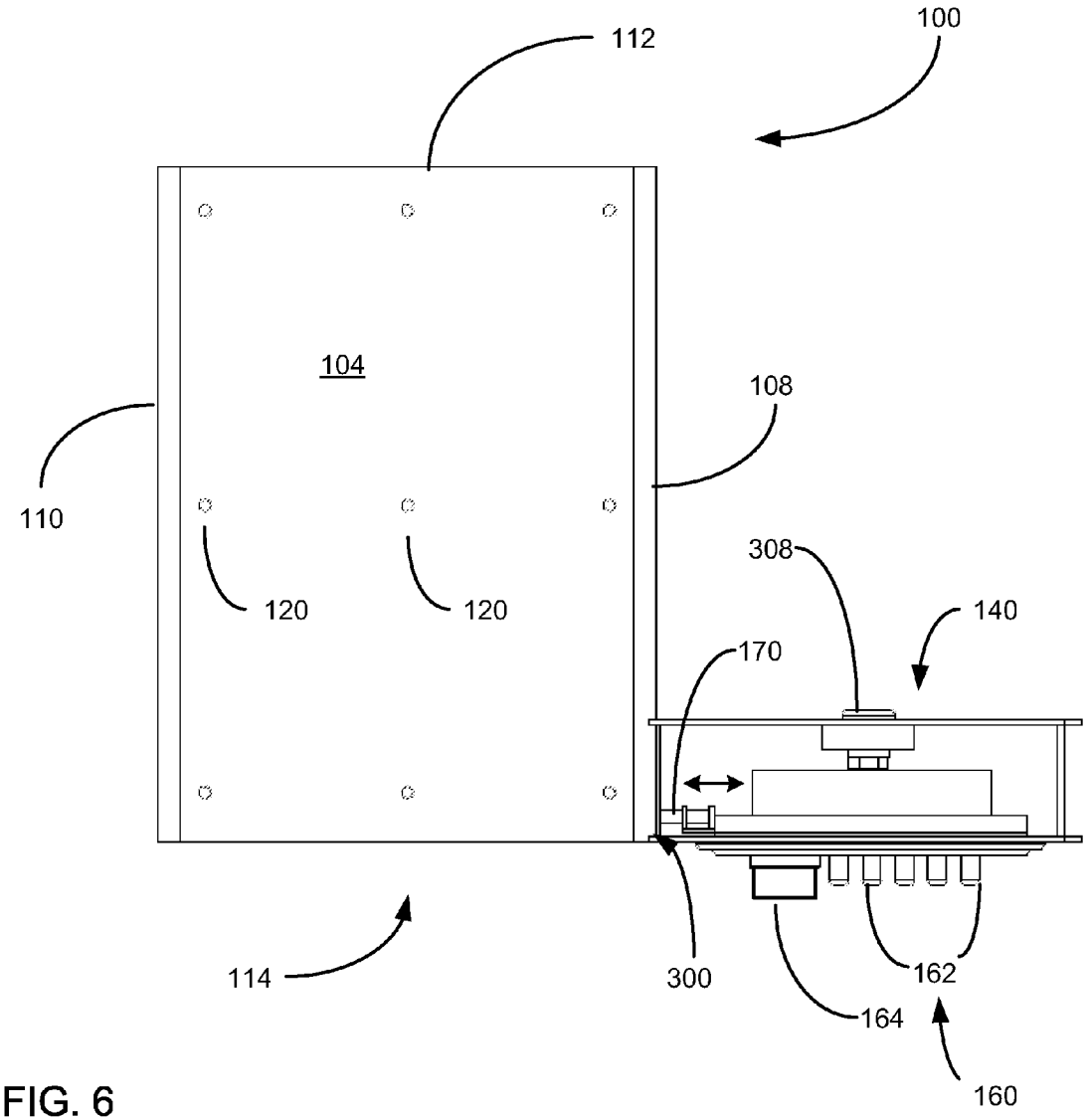
FIG. 6 is a top view of the mounting module of FIG. 5.

FIG. 5 is a front perspective view of the mounting module 16 in one embodiment of the present invention. FIG. 6 is a top view of the mounting module 16 of FIG. 5. The mounting module includes a main body 100 that is a container with an interior space 102 defined by a top surface 104, a bottom surface 106, two side surfaces 108 and 110, an end surface 112, and a exposed opening 114 sized to allow insertion of the portable safe 14. In one embodiment, the mounting module is a rectangular box. However, the mounting module may be any size and shape which can accommodate the portable safe 14 storing the weapon 80. A plurality of holes 120 may be positioned on the top surface 104 to allow the mounting module to be mounted to an unmovable surface (not shown) with a plurality of bolts or screws (not shown). Access holes 196 may be positioned on the bottom surface 106 to allow access for an instrument to attach the bolts or screws into the top surface. A half moon cutout 130 may also be positioned on the bottom surface 106 to allow ease in the insertion and extraction of the portable safe 14. With the portable safe positioned within the interior space 102 of the mounting module, the securing bolts or screws are not accessible.

An access control system 140 may be attached to the main body. As depicted in FIG. 5, the access control system 140 is affixed to the right of the exposed opening 114 of the mounting module 100. However, the access control system may be located anywhere on or adjacent the main body 100 of the mounting module. The access control system includes an access control housing 142 having a top face 144, a bottom face 146, two side faces 148 and 150, and back face 152 and front face 154. The access control system may be any shape which houses the control and locking mechanism allowing access to the portable safe 14 located in the interior space of the mounting module 102. Access to the internal components of the access control compartment may be utilized for component installation and repair as well as allowing access for the installation of screws or bolts to assist in the attachment of the mounting module 100. Access to the access control mechanical controller 160 may be achieved by activating an access control key lock 308 at the back face 152 of the housing and sliding the locking device consisting of the back housing and interior bottom surface out of the confines of the access control compartment. In another embodiment access to the access control electric controller 200 may be achieved with the bottom face 146 hinged to either side face 148 or 150 to allow the bottom face 146 to swing open to gain access to the internal components of the access control components. A key lock (not shown) may be located on one of the faces to provide for controlled entry to the access control system. The interior of the access control system contains access components for either a mechanical or electrical controller configuration. As depicted in FIG. 5, the access control system includes a mechanical controller 160 having an access control push button lock array 162 with a rotating control knob 164. After inputting the correct code into the lock 162, the control knob 164 is able to rotate. Rotating the access control knob 164, 90 degrees moves an access control rod 170 to the open position. The functionality of the control rod will be discussed below.

Figure 7:
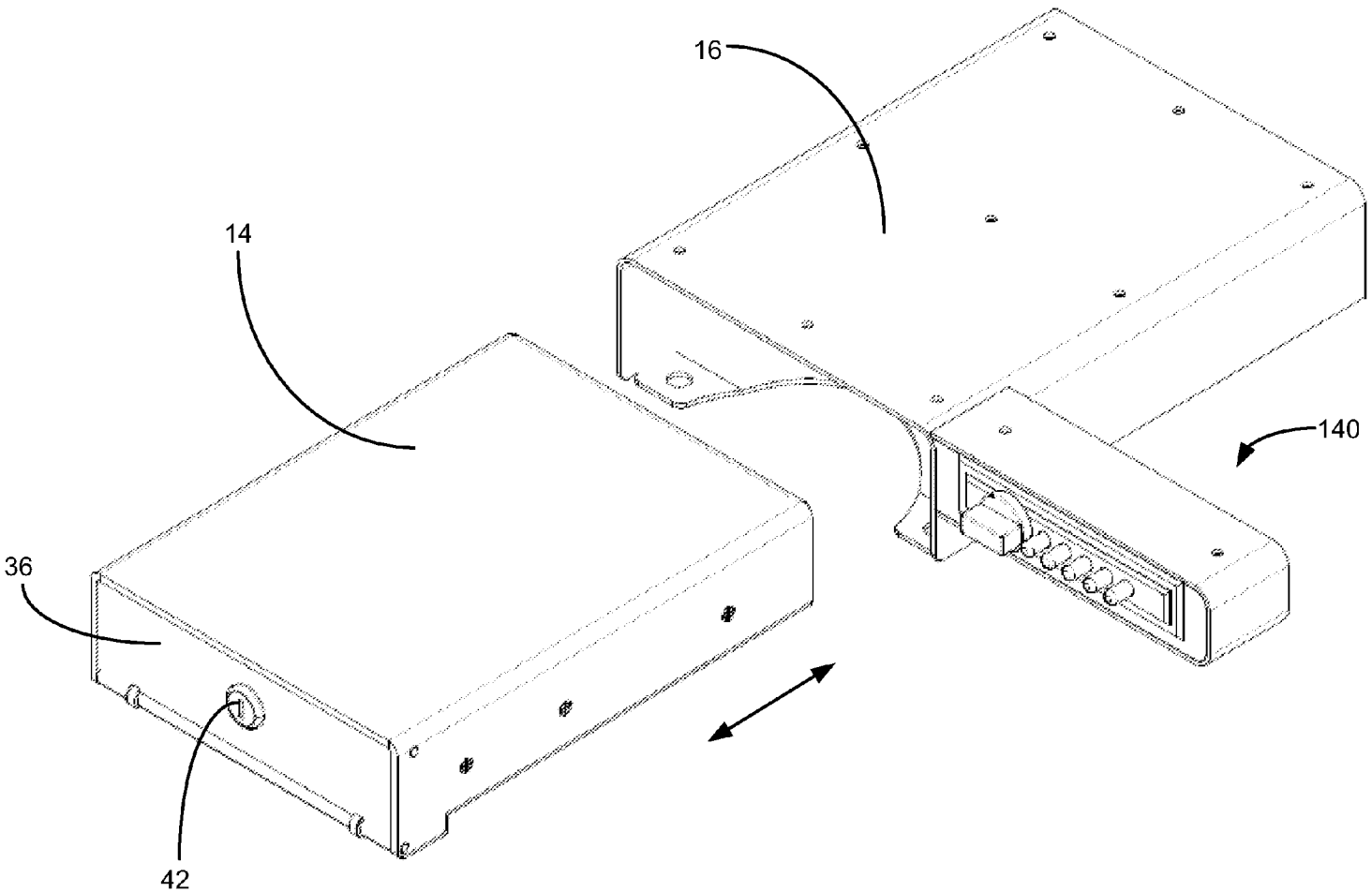
FIG. 7 is a front perspective view of the portable safe in a closed position separated from the mounting module.

FIG. 7 is a front perspective view of the portable safe 14 in a closed position separated from the mounting module 16. As depicted, the door 36 of the portable safe is closed. The key lock 42 of the portable safe is also shown. When desired by the user, the portable safe (with the weapon 80) may be slide within the interior space of the mounting module 102.

Figure 8:
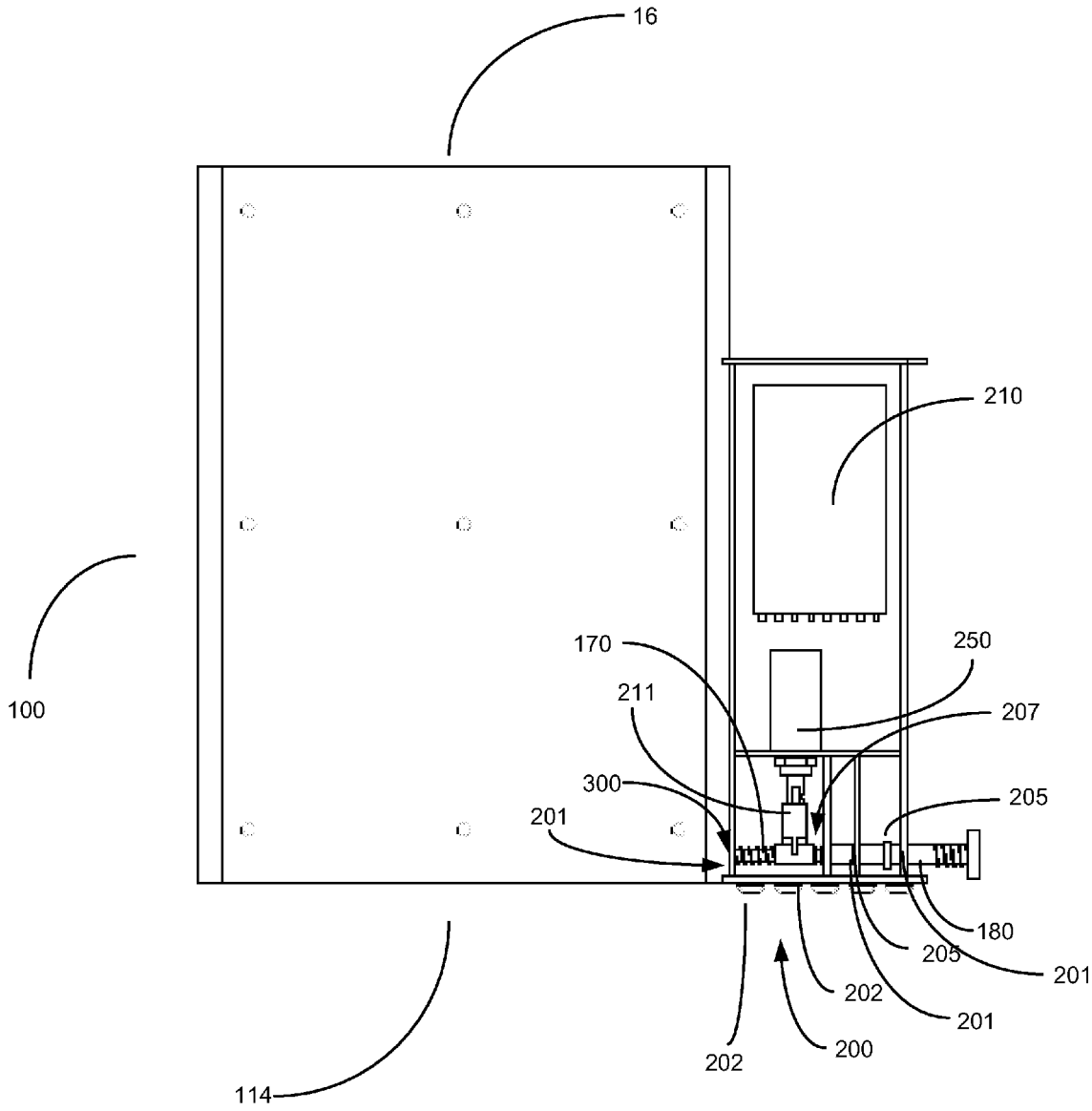
FIG. 8 is a top view of the mounting module having an electronic controller in a second embodiment of the present invention.

FIG. 8 is a top view of the mounting module 16 having an access control electronic controller 200 in a second embodiment of the present invention. The access control electronic controller 200 performs the same function of moving the access control rod 170 as does the access control mechanical controller 160. The access control electronic controller 200 may include an identification reader such as a push button controller 202 (as depicted in FIGS. 1 and 8) a portable biometric finger print reader, or an activation device initiated by a motion detector, security alarm system, remote switch, wired or wireless device or any other mechanism capable of sending an electrical signal to the controller which activates an access control solenoid 250 opening the door 36 to the portable safe. The housing of the access control system may include electronic components 210, such as the power supply, possessor, encoder or any component necessary for the function of the control system. Holes may be placed on the back face to accommodate electrical connections for a power supply and various access readers such as a biometric scanner, USB port for a computer or mobile device, telephone or any other connection to accommodate an activation device. Internally in the access control electronic controller 200 may be electronic controller rod guides 201 that run parallel to the front face surface of the electronic controller 200. Positioned within the electronic controller rod guides 201 may be two independent rods, an access control rod 170 and an access control push rod 180. The electronic controller rod guides 201 work to facility the smooth precise movement of the push and control rods as well as a stop for the push rod. A push rod guide stop 205 may be installed for limiting the extended motion of the access control push rod 180 during activation.

In one embodiment, the access control push rod 180 is a two-piece rod spring-loaded to the open position and situated both internal and external to the access control system housing. One end of the push rod is a knob positioned at the external end of the rod allowing adequate surface area to physically push the push rod closed and over come the force from the compression springs of the locking and control rods. The other end of the push rod is flared at the end and threaded into the rod to accommodate assembly. The flared end of the internal end of the push rod and the push rod guide stop 205 prevents someone from tampering with the locking device by only allowing the push rod limited movement to the closed position. As the push rod 180 is pushed in, or to the closed position, the internal end of the push rod makes contact with the push rod guide stop 205 prohibiting further movement forward, which could potently damage the locking device. The access control rod 170, for either the mechanical or electronic controller, is preferably a reciprocating spring loaded rod that remains in an open position until physically pushed closed by either rotating the access control knob 164 for the mechanical controller or pushing in on the access control push rod 180 for the electronic controller. By pushing in on the access control push rod 180, contact may be made with the access control rod 170 moving it in proportion to the access control push rod 180. The extendable and retractable access control rod 170 is affixed to the mounting module and penetrates the main bodies of the mounting module 100 and the portable safe 20 at 300. The portable safe 14 may be secured to the mounting module 16 by moving the access control rod 170 to the closed position. An access control solenoid 250 and solenoid guide stop 211 may be positioned perpendicular to the access control rod 170. As the access control rod 170 moves to the closed position the solenoid guide stop 211 applies pressure to access control rod 170 from the internal spring in the solenoid 250. As the access control rod 170 continues to move, the solenoid guide stop 211 moves across the surface of the access control rod 170 until reaching the control rod indentation stop 207 in the control rod 170, where the solenoid guide stop 211 falls into the control rod indentation stop 207, thereby allowing the access control rod 170 to be held in place. Additionally, the movement of the access control rod 170 contacts the access control locking rod 52 moving it in proportion to the access control rod 170. As the access control locking rod 52 is closed it penetrates the portable safe interior door locking device 44 and locks the door 36 of the portable safe. When the security key lock 42 on the portable safe is positioned to the unlock position, the door 36 of the portable safe is secured by the access control locking rod 52 and activated by the access control system 140. The access control rod 170 and the access control locking rod 180 are held in the extended or open position by compression springs and in the retracted or locked position by the solenoid 250 (for the embodiment having the electronic controller) or the control knob 164 for the mechanical controller. Activation of the solenoid is controlled by the access control electronic controller 200. As the access control solenoid 250 is activated, the solenoid moves the solenoid guide stop 211 to the retracted position out of the control rod indentation stop 207, which allows the spring-loaded access control rod 170 to retract from the main body of the portable safe 20. The retraction of the access control rod 170 allows the access control locking rod 52 to also retract from the portable safe interior door locking device 44, allowing the door 36 of the portable safe to spring open, activating the weapon tray hold back mechanism 192 and extending the weapon tray 12 from the portable safe main body interior space 22. The weapon 80 and weapon accessories are then exposed to the authorized user. A time controlled LED light 92 may illuminate the weapon and weapon accessories, thereby providing the user adequate visibility to retract the weapon and or accessories from the weapon tray 12.

With reference to FIGS. 1-11, the operation of the portable weapon safe system 10 will now be explained. First, the mounting module 16 is mounted to a fixed surface, such as an underside of a bed, desk or nightstand, which is easily accessible by the user. The mounting module is mounted by driving screws or bolts from the interior space 102 through the holes 120 in the top surface 104 of the mounting module to the fixed surface. The weapon 80 is positioned in the weapon tray 12. As discussed above, the top and bottom sides of the weapon tray are preferably in an open configuration to allow the handle of the weapon to be exposed at area 82. However, in the preferred embodiment of the present invention, with the weapon positioned in the weapon tray 12, the trigger and trigger guard of a weapon 80 are not accessible when positioned in the weapon tray, thereby eliminating any accidental misfire when physically extracting the weapon from the tray. Preferably, the front side 68 of the weapon tray remains open for extracting the weapon from the tray.

When storing the weapon 80, the weapon tray 12 is retracted into the interior space 22 of the body of the portable safe by manually pushing on the weapon tray closure mechanism 94. The sides of the weapon tray 12 are affixed to the drawer slides of the main body of the portable safe enabling the tray to reciprocate to an extended or retracted position. As physical force is applied to the closure mechanism 94, a release rod 96 attached to the tray stop assembly 191 is activated, forcing the weapon tray stop retraction mechanism 195 to the down position allowing the tray to retract into the interior space of the portable safe. Additional physical force overcomes the force of the gas spring and moves the weapon tray forward to the retracted or closed position within the interior space 22 of the portable safe 14. As the tray reaches the retracted position, the weapon tray hold back mechanism activates to hold the weapon tray in the closed position.

With the weapon tray and weapon stored in the portable safe 14, the weapon is easily and safely transportable. The door 36 of the portable safe may be closed and locked. The portable safe may be used to transport the weapon and prevent others from accessing the weapon stored within the portable safe. The safe may be transported to any location as the portable safe is capable of being carried by hand. The safe may include a handle (not shown) for ease in carrying the portable safe. The user may have a plurality of mounting modules located within a living or work space. Since only one portable safe is needed, cost is reduced since the safe is transportable to other locations. In the preferred embodiment of the present invention, the portable safe is utilized in conjunction with the mounting module having an access controller. However, the present invention may be used with a mounting module that does not posses an access controller. When used strictly as a portable safe, access control is accomplished utilizing the key actuated locking device. Its small size and quick access ability allow it to be utilized in a variety of concealment situations, such as in a briefcase with the face of the safe exposed for quick access or in a kitbag utilized by commercial aircrew while fulfilling the duties of protecting the cockpit.

When desired, the portable safe 14 and stored weapon 80 are placed within the interior space 102 of the mounting module 16. With the portable safe positioned within the interior space 102 of the mounting module, the securing bolts or screws are no longer accessible. When stored in the mounting module, the door 36 of the portable safe is closed.

When the user desires access to the stored weapon 80, the user accesses the system 10 by interacting with the access control system 140. In one embodiment, the access control system 140 includes a mechanical controller 160. In this embodiment, the user presses a code into the push button array 162, which allows the control knob 164 to be rotated, thereby moving the access control rod 170 to the open position.

In another embodiment, the access control system 140 includes the access control electronic controller 200. The electronic controller may include an identification reader, such as a biometric scanner or push button lock. In one embodiment, the user contacts a hand or one or more fingers upon the electronic controller which is then read by biometric device, such as the identification reader. The user and any other person's hand or fingerprints may be stored in a memory of the electronic controller. When accessing the access control system 140, the identification reader matches the stored biometric information with the scanned biometric information of the user (e.g., fingerprints).

For both the electronic and mechanical controllers, upon proper verification of the identity of the user or properly inputted code, the access control rod 170 may be moved. The access control rod 170, which is affixed to the mounting module, prior to access by the user, penetrates the main body of the portable safe at 300 securing the portable safe to the mounting module, which may be secured to a permanent fixture. The portable safe door 36 is locked by the proportional movement of the access control rod 170 moving the portable safe locking rod 52, which penetrates the portable safe door lock 44. To allow quick access to the weapon, the security key lock 42 on the portable safe is positioned to the unlocked position. Thus, the door to the portable safe 36 is now secured by the portable safe locking rod 52 and activated by the access control system. The control and locking rods are held in the extended or open position by a spring and in the retracted or locked position by a solenoid. Activation of the solenoid 250 is controlled by the access control system. Activation of the solenoid retracts the solenoid guide stop 211 from the control rod indentation stop 207 in the access control rod 170, thereby allowing the spring-loaded control rod to retract from the main body of the safe. As the access control rod 170 retracts, the portable safe locking rod 52 retracts in proportion, thereby unlocking the portable safe interior door lock 44 and allowing the door 36 of the portable safe to spring open. By opening the door 36 of the portable safe, the weapon tray 12 automatically extends from the portable safe. Specifically, as the door swings to the open position, 180 degrees, at approximately 160 degrees from the closed position the portable safe door hinge mechanism 41 forces the weapon tray holdback mechanism 192 out of the door hinge support recess 43 of the portable safe door hinge support 40. This action allows the weapon tray 12 with the force of the gas spring 190 to partially extend from the interior space 22 of the portable safe to expose the weapon 80 and weapon accessories. A weapon tray stop mechanism 194 keeps the weapon tray from over-extending from the interior of the weapon safe. The user can then remove the weapon 80 from the tray.

In an alternate embodiment of the present invention, the access controller may be actuated by a remote wireless or hard wired unit, such as a mobile phone communicating with the access controller of the system 10. The remote wireless or hard wired unit may contain an phone application by which the user utilizing the mobile phone touch screen inputs a code, fingerprint recognition of the user, or other security application which enables the remote wireless or hard wired unit to authenticate a user, and upon authentication, send a message to the access control to open the safe. Electrical power can be obtained from the access control system 140 to supply electrical power to the mobile device for battery recharge and uninterrupted use.

The present invention provides many advantages over existing weapon safes. The present invention includes a portable safe which is capable of safely storing a handgun-size weapon and accessories. The key lock provides access to the weapon stored in the portable safe. The tray may be ejected from the safe, thereby allowing quick access to the stored weapon 80. The mounting module is mounted to an unmovable object and serves as a secure containment of the portable safe. The portable safe is inserted into the exposed opening 114 of the mounting module and locked by means of the control rod 170 that is inserted into the body and door lock of the portable safe. The mounting module is a multi-functional unit. It has the ability to store and secure a portable safe to an unmovable object, eliminating the risk of theft to the portable safe. The method of securing the portable safe to the mounting module always allows for the safe to be locked at all times, which never exposes the weapon to an unsecured condition. Lastly, the mounting module functions as a control mechanism for the activation of the portable safe's door. Multiple mounting modules may provide the user a wide variety of different access devices, from the simple key lock found on the portable safe to a biometric or wireless access function. Once the mounting module's control rod is inserted into the portable safe, the mechanical door lock on the safe can be unlocked, thus giving complete control over to the access control system 140. This assures the weapon is never handled or exposed to an unsecured condition. Accessing the weapon is then completely controlled by the access control system. The portable safe can be extracted from the mounting module by locking the portable safe with the key lock and activating the access control system. In this case, the door of the portable safe never opens, but the safe is released from the mounting module and is accessible by a key lock access function while maintain ease in transportation. The portable safe can know be used to transport the weapon in a secure and safe environment to a variety of different locations. When the entire safe and its contents are moved, the weapon is never exposed, eliminating the risk of an accidental misfire due to mishandling of the weapon. Multiple mounting modules can be positioned throughout a home, office, vehicle, or wherever rapid access, convenience and weapon security are desired. The portable safe is very effective when utilized in conjunction with the mounting module with access controllers, but may be used with a mounting module that does not possess an access controller. When used strictly as a portable safe, access control may be accomplished by utilizing the key actuated locking device. Its small size and quick accessibility allow the portable safe to be utilized in a variety of concealment situations, such as in a briefcase with the face of the safe exposed for quick access or in a kitbag utilized by commercial aircrew while fulfilling the duties of protecting the cockpit, or permanently mounted in the confines of an automobile.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A system for securely storing a weapon, the system comprising:

a tray for containing the weapon, the tray having an opening for accessing the weapon;

a portable safe having an interior space sized and shaped for retaining the tray and the contained weapon, wherein the portable safe includes a door for accessing the interior space; and a mounting module having means for affixing the mounting module to a fixed surface, the mounting module having:

an interior space for holding the portable safe; and an access control system for locking the portable safe within the interior space of the mounting module, the access control system having means for allowing access by an authorized user and denying access of the weapon within the portable safe to an unauthorized user;

wherein the access control system is a control mechanism for locking and opening the door of the portable safe;

wherein the weapon is contained in the tray, the tray is retained in the portable safe and the portable safe is locked in the interior space of the mounting module with the door of the portable safe being exposed outside of the mounting module;

whereby the authorized user accesses the access control system to open the door of the portable safe and access the weapon in the tray.

2. The system according to claim 1 wherein the portable safe is an enclosure and the door is spring-loaded to an open position.

3. The system according to claim 2, wherein the portable safe may be removed from the mounting module and transported to another location while securely retaining the weapon.

4. The system according to claim 3 wherein the door includes a key lock for manually locking the door to a closed position, thereby preventing access to the retained weapon.

5. The system according to claim 2 wherein:

the portable safe includes a locking rod for securing the door in a closed configuration, the locking rod being coupled to the access control system; and means for opening the door automatically upon moving the locking rod.

6. The system according to claim 5 wherein the tray includes means for automatically extending outside the portable safe when the door is opened.

7. The system according to claim 1 wherein the system includes a light for illuminating an area near the system, when the tray extends outside the portable safe.

8. The system according to claim 1 wherein the tray includes a covered portion to guard a trigger of the retained weapon, thereby preventing inadvertent handling of the trigger of the weapon when removing the weapon from the tray.

9. The system according to claim 1 wherein the access control system includes an electronic controller.

10. The system according to claim 9 wherein the electronic controller includes a biometric system for identifying a specified person, the biometric system providing access to the portable safe upon positively identifying the specified person accessing the access control system.

11. The system according to claim 1 wherein the tray includes an insert for retaining the weapon in the tray.

12. The system according to claim 1 wherein the access control system includes a remote wireless unit communicating with the access control system, the remote wireless unit having means for authenticating an authorized user and means for communicating with the access control system upon authenticating the authorized user.

13. The system according to claim 12 wherein the wireless unit is a mobile phone having an application for authenticating the authenticated user.

14. The system according to claim 1 wherein the tray is adjustable for accommodating both right-handed and left-handed authorized users.

15. The system according to claim 1 wherein the access control system includes a mechanical controller.

16. The system according to claim 15 wherein the mechanical controller includes a push button array and control knob coupled to the locking rod, whereby the user selects a specified code on the push button array and moves the control knob to move the locking rod.

* * * * *